United States Patent [19]

Marquez

[11] 4,100,998

[45] Jul. 18, 1978

[54] LADDER STEP

[75] Inventor: Manuel J. Marquez, Salem, Oreg.

[73] Assignee: The Raymond Lee Organization, Inc., New York, N.Y.

[21] Appl. No.: 732,306

[22] Filed: Oct. 14, 1976

[51] Int. Cl.[2] ..... E06C 7/16

[52] U.S. Cl. ..... 182/116

[58] Field of Search ..... 182/121, 122, 120, 228, 182/214, 116, 88

[56] References Cited

U.S. PATENT DOCUMENTS

| | | | |
|---|---|---|---|
| 812,620 | 2/1906 | Alstine | 182/121 |
| 1,593,366 | 7/1926 | Singer | 182/121 |
| 2,069,969 | 2/1937 | Nelson | 182/121 |
| 2,767,897 | 10/1956 | Hoffman | 182/116 |

*Primary Examiner*—Reinaldo P. Machado
*Attorney, Agent, or Firm*—Stephen Wyden

[57] ABSTRACT

A platform mounted on rails on each side of the platforms can slide on a round headed bolt attached to each of the inside surfaces of a ladder and the platform can be secured by a clamp at a distal end of the platform to a rung of the ladder, a bearing attached to the front edge of the platform and attached to a support arm can be attached to a lower rung of the ladder by a clamp attached to a distal end of the support arm to support the front edge of the platform, and a front lip attached to a front edge of the platform can be used to pull the step forward and backwards; a rugging material can be attached to a surface of the platform to comfort the feet of a user.

4 Claims, 4 Drawing Figures

LADDER STEP

I have invented a new and novel improved ladder step. My improved ladder step may be incorporated into every step of a folding ladder or may be incorporated as an attachment to individual steps of an extension ladder. Furthermore, my improved ladder step may be pulled out with a toe tip of a user's foot to open the improved extendible ladder step for use.

My invention can be understood in view of the accompanying figures.

Figure 1:
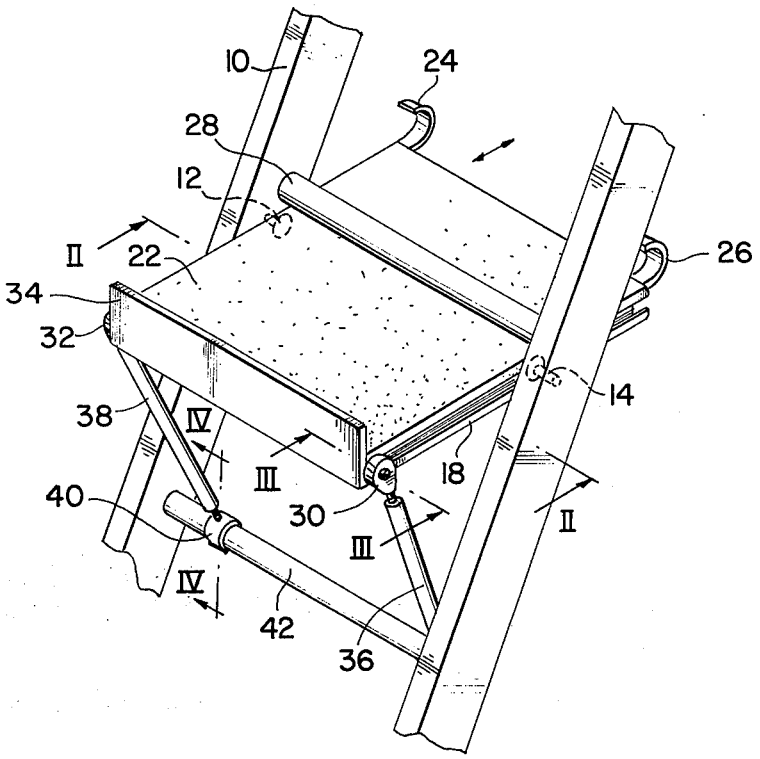
FIG. 1 is a perspective view of the device in use on a ladder step.
Figure 2:
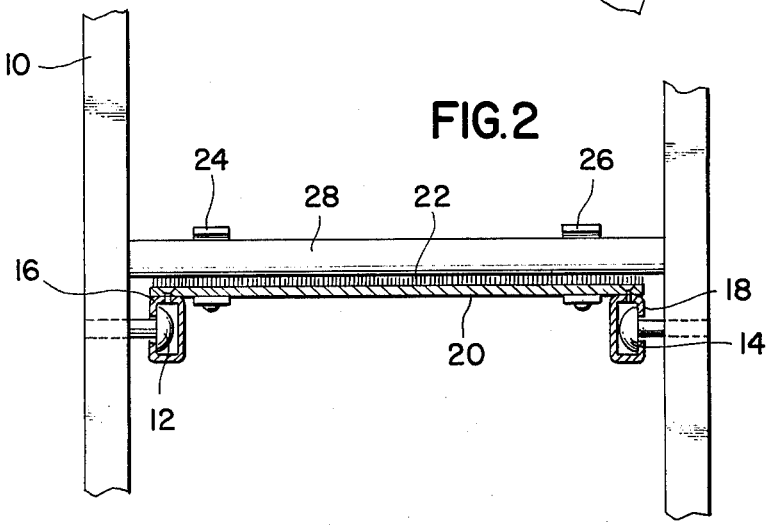
FIG. 2 is a section of the device disclosed in FIG. 1 taken along the plane 2—2 of FIG. 1.
Figure 3:
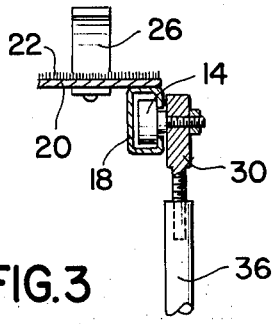
FIG. 3 is a section of the device shown in FIG. 1 taken along the plane 3—3 of FIG. 1.
Figure 4:
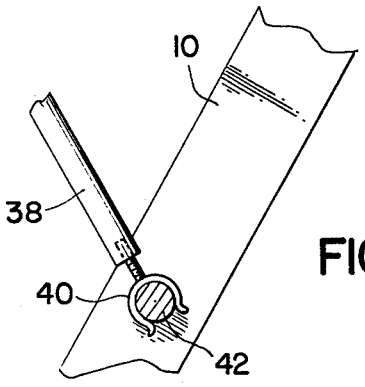
FIG. 4 is a section along the plane 4—4 of the device shown in FIG. 1.

With regard to FIGS. 1, 2, 3, and 4, on the insides of the rails of a ladder 10 round headed bolts 12 and 14 may be attached extending inwardly to support runners 16 and 18 which in turn support a platform 20 on the upper surfaces. A pile rugging material 22 can be attached to the top of the platform 20 to cushion the step of the user. Hooks 24 and 26 attached to a rear portion of the platform 20 can secure the rear edge of the platform 20 against one of the rungs 28 of the ladder 10 when the ladder is pivoted forwardly. The platform 20 can be pivoted on bearings 30 and 32 as the front lip 34 attached to the front edge of the platform 20 is moved forward and backward. The bearings 30 and 32 are connected to arms 36 and 38 which in turn are connected to clamps such as 40 for securing the lower end of each of the arms 36 and 38 to a lower rung 42 of the ladder 10.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. An improved ladder step, comprising:

a platform, the platform attachable to a ladder, a rugging material attached to an upper surface of the platform, a front lip attached to a front edge of the platform, a pivotable bearing attached to a front side of the front edge of the platform, a support arm dependingly attached to the bearing, a clamp attached to a lower end of the support arm and releaseably engageable with a lower rung of the ladder, a rail attached to a lower side edge of the platform, & a headed bolt attached to an inner side of a rail of the ladder and slidingly engageable by the rail.

2. The improved ladder step of claim 1, further comprising:

a clamp attached to a distal edge of the platform and releaseably engageable with a runner of the ladder above the platform.

3. The improved step ladder of claim 2, wherein the ladder is of the folding type.

4. The improved step ladder of claim 2, wherein the ladder is of the extension ladder type.

* * * * *